US005930580A

United States Patent [19]

Everett

[11] Patent Number: 5,930,580

[45] Date of Patent: Jul. 27, 1999

[54] METHOD FOR FORMING POROUS METALS

[75] Inventor: Richard K. Everett, Alexandria, Va.

[73] Assignee: The United States of America as represented by the Secretary of the Navy, Washington, D.C.

[21] Appl. No.: 09/069,932

[22] Filed: Apr. 30, 1998

[51] Int. Cl.[6] ..... B22F 3/12

[52] U.S. Cl. ..... 419/2; 419/39; 419/48; 419/49

[58] Field of Search ..... 419/2, 39, 48, 419/49; 75/245; 501/82, 81

[56] References Cited

U.S. PATENT DOCUMENTS

| | | | |
|---|---|---|---|
| 3,052,967 | 9/1962 | Fischer . | |
| 4,777,153 | 10/1988 | Sonuparlak et al. | 501/82 |
| 5,080,378 | 1/1992 | Kagawa | 277/96 |
| 5,592,686 | 1/1997 | Thirc et al. | 419/2 |
| 5,610,110 | 3/1997 | Azema et al. | 501/88 |
| 5,625,861 | 4/1997 | Nishi et al. | 419/2 |
| 5,635,430 | 6/1997 | Divakar et al. | 501/90 |

*Primary Examiner*—Ngoclan Mai

*Attorney, Agent, or Firm*—Thomas E. McDonnell; George Kap

[57] ABSTRACT

A porous material of desired porosity and pore size is made by mixing a particulate material and fungible beads that are thermally decomposable until the desired distribution is attained; compacting the mixed material and beads to form a green body that has sufficient strength to be handled where the beads are undecomposed; and compacting and heating the green body to fuse the material particles and to decompose the beads to gas.

18 Claims, 2 Drawing Sheets

METHOD FOR FORMING POROUS METALS

BACKGROUND OF INVENTION

1. Field of Invention

This invention pertains to porous material fabrication by controlling pore size, pore distribution, pore volume fraction and thus the mean nearest-neighbor distance between the pores using beads which are thermally decomposable to a gas.

2. Description of Prior Art

The principal class of porous material products, particularly porous metal products, are made by powder metallurgy. The powder metallurgy process includes primarily the steps of mixing batch components, including particulate or powdered material; compacting the batch components to form a green body which holds its shape; and sintering the green body at elevated temperature and pressure to form a porous material. The porous material is typically machined to obtain a final porous material product.

Casting involves melting and molding of hot liquid material into product and cooling the molten material to a solid state. One form of casting is the lost-foam casting process wherein connected pores in a plastic foam are filled with a refractory which is then cured. Upon heating combustion of the sacrificial foam leads to formations of a sponge-like solid. This solid is typically used as a mold for material which solidifies in its pores. This process is primarily used for making porous metals with low melting points.

Melt foam generation is hard to control and foamed materials contain large bubbles non-uniformly distributed throughout the casting. Numerous attempts have been made to prevent this defect, as by vigorous stirring, application of magnetic fields, or thickening. Problems, however, persist due to the relatively short time between the introduction of the foaming agent and the generation of foam. Further difficulties arise from premature decomposition of the hydride or another foaming agent. Thickening additives often impair mechanical properties of the foamed material.

Infiltration of a granular bed is in many respects similar to lost-foam casting. It yields a continuous structure by melt infiltration of a bed of granules contained in the casting mold. The granules are made of a soluble but thermally stable material that is removed by chemical treatment. To ensure free flow of the melt, it should be superheated. It is also desirable to preheat the granule bed and pressurize the melt or evacuate the spaces between the granules. An alternative method involves introducing granules into the melt while it is vigorously stirred.

A rather recent fabrication of foamed aluminum involves introduction of air or another gas into a molten aluminum puddle while simultaneously stirring the melt in the bubbling zone. A surfactant is concurrently injected with the gas to stabilize the foam. In this continuous process, the foam is fed into a horizontal or vertical mold to freeze, forming sheets, tubes, or other products with porous structure. The method offers high output, is simple and cost-efficient, and allows pore-size control over a fairly wide range. An important advantage of this technology is the possibility of using aluminum of any degree of purity, and thus recycling aluminum scrap.

In the gas-eutectic transformations of the metal-hydrogen systems, the liquid decomposes into a solid and a gas phase: $L \rightarrow S+G$. The transformation may take place if the phase diagram for the metal-hydrogen system involves a gas-eutectic equilibrium. Making the material includes two steps:

a. charging a molten material with hydrogen to reach the eutectic composition, and b. solidification in a conventional or continuous casting mold.

No melt foaming occurs here because the gas is evolved as the melt freezes. The process is in many ways similar to conventional eutectic solidification, the distinction being that the liquid decomposes into a solid and a gas rather than into two solids. The main process variables that govern the amount of porosity and the size, shape, and orientation of the pores are the hydrogen level in the melt, gas pressure over the melt during solidification, direction and rate of heat removal, and the material chemical composition. By changing these variables, one can control the pore structure over a wide range.

OBJECTS AND SUMMARY OF INVENTION

An object of this invention is to make a porous material, particularly a porous metal, without melting the material with beads of a size directly proportional to the size of the pores in the porous material.

Another object of this invention is fabrication of porous material from particulate material wherein the material particle boundaries are not contaminated.

Another object of this invention is fabrication of porous material with the desired mean nearest-neighbor distance which affects mechanical properties of the porous material.

Another object of this invention is fabrication of porous material by a method which enables control of porosity, control of pore size, and control of pore spatial distribution.

These and other objects of this invention can be realized by making porous material, particularly porous metals and alloys, by initially mixing a particulate material with thermally decomposable beads to form a batch, compacting the batch to form a green body thereof wherein the beads are in their undecomposed state, and compacting while heating the green body to fuse the particles of the particulate material and to decompose the beads to a gas which forms the pores in the porous material.

DESCRIPTION OF PREFERRED EMBODIMENTS

Figure 1:
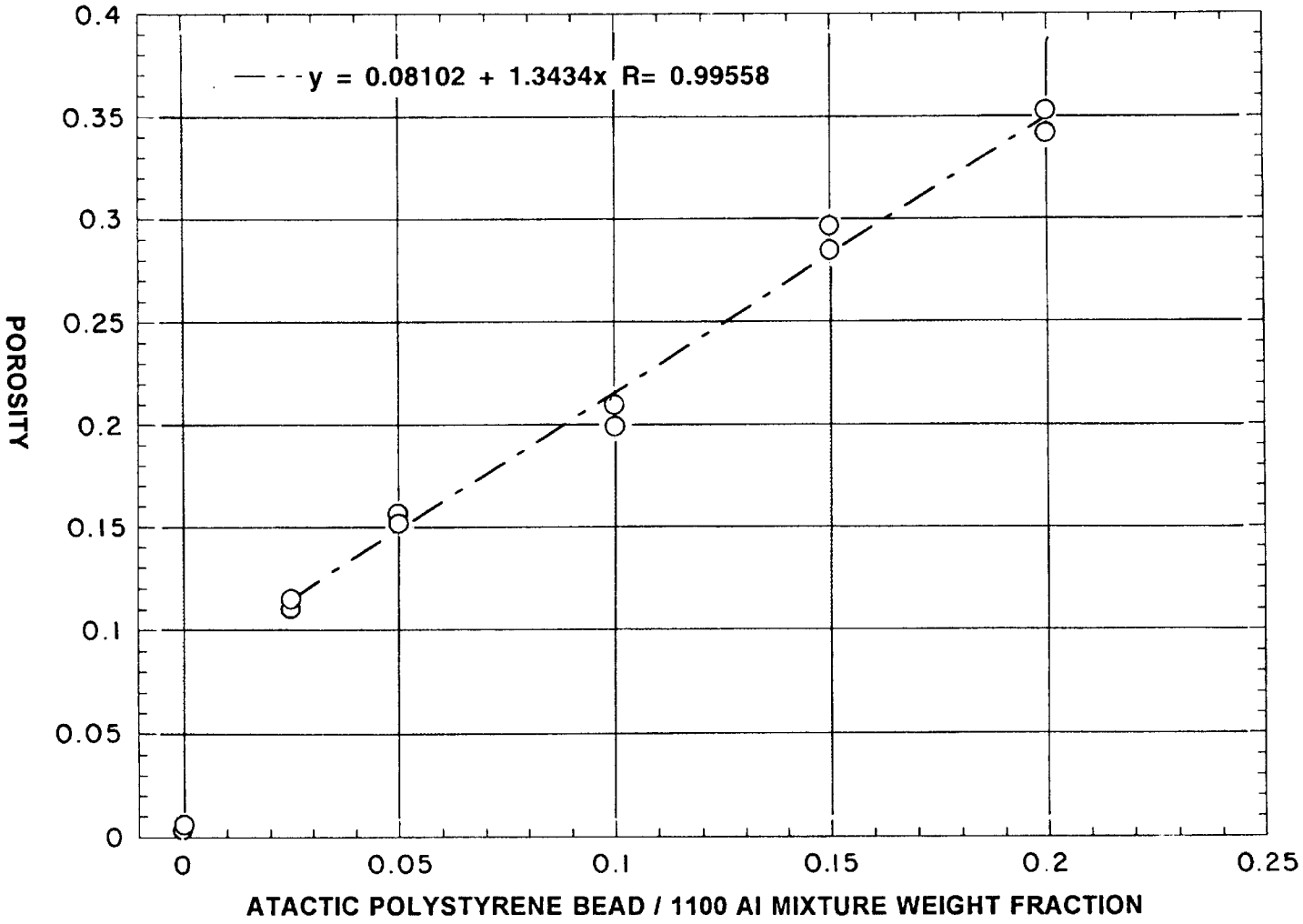
FIG. 1 is a graph which gives relationship of weight fraction of polystyrene beads and aluminum powder, and porosity of a porous aluminum samples made with the beads pursuant to the invention herein.

This invention pertains to a powder metallurgy method of making porous materials by mixing a particulate material with thermally decomposable beads to form a batch, compacting the batch to form a green body thereof wherein the beads are in their undecomposed state, and compacting while heating the green body to fuse the particles of the material together and to decompose the beads to gas.

The particulate material is typically in powder form. The particle size is not critical but the material should be in a particulate form since the beads are interposed between the material particles and eventually form pores between the particles upon decomposition.

The material includes ferrous and non-ferrous metals, alloys of the metals, and non-metallic materials. More specifically, the materials contemplated herein include metals, intermetallic compounds, alloys and ceramics. It is conceivably possible to make a porous plastic by the method described herein wherein the particulate plastic has a higher decomposition temperature than the beads. Thus, in the embodiment where a particulate plastic material is used, the plastic must be able to withstand the pressure and temperature at which the beads decompose to form the pores. Of particular significance in making porous materials are metals and alloys of metals such as iron (1530° C. melting point or mp), copper (1083° C. mp), nickel (1455° C. mp), magnesium (651° C. mp), titanium (1800° C. mp), and aluminum (659° C. mp). Iron, copper and aluminum alloys are of particular significance. The iron or ferrous alloys contemplated herein include steels. The copper alloys contemplated herein include brass and bronze. The aluminum alloys contemplated herein include 1100, 2024 and 6061. Examples of suitable ceramics which can be made into a porous ceramic, pursuant to the method herein, include alumina and silica.

Particle size of the material can vary greatly. The particle size can vary from the smallest available to the largest below pellet size. There does not appear to be a lower limit but the upper end will be limited if the material particles arc so large that they trap clusters of the beads and good distribution of the pores is not obtained, particularly if control of pore size is desired. For purposes herein, typical material is in powder form having an average particle size of up to about 500 microns, more typically 0.5 to 200, and especially 10–100 microns.

The fungible or the thermally decomposable beads that produce pores in the porous material are in a solid form and their shape is typically spherical although the beads can have any other shape. The beads essentially retain their shape when the green body is formed but decompose into gas leaving essentially no solid residue on decomposition. Decomposition of the beads takes place below the melting temperature of the material, typically at a temperature at least 100° C., more typically at least 200° C. below melting temperature of the matrix material. The beads are typically in the form of powder having average particle size of up to about 10,000 microns, more typically 0.05 to 2000 microns, and especially 0.1 to 1000 microns. Amount of the beads and their particle size generally determine porosity and pore size of the resulting porous material. The beads can be microballoons, which are hollow inside, or they can be solid throughout. The beads can be of any substance as long as they are thermally decomposable to a gas. Typical beads are plastic, particularly polystyrene , decomposing below about 300° C., polyethylene and polyisobutylene. Due to processing variations, complete decomposition may not be attained. The resulting spherical cavity, even if it contains a carbon ash, is still a pore. Any carbon ash in the pores does not detract from the useful properties of the material.

Porosity of an article is determined by the amount of beads used. Porosity of up to about 90% can be attained with the method described herein. For instance, 25 g of polystyrene beads, having an average particle diameter of about 250 microns, mixed with 225 g of particulate 1100 aluminum, having an average particle size of 63 microns, can produce a porous aluminum article with about 20% porosity and pores varying in diameter from about 100 to 500 microns.

The method can be initiated by weighing out the desired amount of the particulate material and the beads and placing them into a mixer where they are mixed until a random distribution is obtained. This duration varies a great deal depending on the parameters but typically up to 12 hours, if a commercial blender is used.

After mixing the particulate material and the beads, and anything else that goes into the batch, the batch is compacted at an ambient temperature in order to obtain a green body which does not have much strength but is cohesive enough to be unitary. In the green body, the material particles are held together by the compacting forces and the beads are held in the pockets created by the cohesive particles. The beads in the green body generally remain undecomposed and retain their original shape and size.

In a preferred embodiment, the mixed particulate material and the beads are placed into a flexible container or bladder, the bladder is sealed and then is placed into a cold isostatic press where the bladder is pressurized to form the green body. The pressure depends on the particular particulate material and beads employed. The compaction pressure is typically in the range of up to about 200,000 psi, and more typically 10,000 to 150,000 psi, and especially 60,000 to 120,000 psi. Duration of the compaction step is typically less than ½ hour, more typically less than ¼ hour, and especially less than 10 minutes. For aluminum powder and polystyrene beads, the pressure is 90,000–95,000 psi and it is applied for a short hold time of 1–2 minutes. The pressure is typically applied at room temperature.

After the green body is formed, it is subjected to an elevated pressure and a high temperature to soften and fuse or sinter the particles of the particulate material, and to thermally decompose the beads to gas so that pores are formed. The elevated pressure is below the compaction pressure when the green body is formed and the high temperature is below the melting temperature of the material but above the decomposition temperature of the beads. The combination of pressure and temperature should be sufficient to soften and fuse the particles of the particulate material together and to decompose the beads to gas.

In a preferred embodiment, the green body is removed from the cold isostatic press, after depressuring same, and then from the bladder. The green body is then wrapped in a foil which serves as a physical barrier to prevent diffusion in or out of the green body. Formation of any low melting point eutectic is principally of concern here. If a porous aluminum-containing article is being made, a tantalum foil can be used since tantalum does not appear to deleteriously react with aluminum at the temperatures and pressures involved. Also, the tantalum foil absorbs/reacts with gases from the beads and thus the gases are dissipated. If another porous metal than aluminum is being made, then another metal foil, such as titanium foil, can be used. After wrapping with a protective foil, the green body is wrapped with another protective foil, as a precaution. If the green body contains aluminum, the green body is wrapped initially with a tantalum foil and then with a stainless steel foil for further protection.

The wrapped green body is sealed in a vacuum retort. Typically, the retort is a seam-welded stainless steel pouch. The pouch is evacuated, and then seam-welded shut. Evacuation of the pouch is done principally to remove oxygen since if oxygen is present, it reacts with the contents creating problems. Evacuation is done to as low a vacuum as possible, which typically is below $50\times10^{-3}$ Torr.

The evacuated pouch is then placed into a hot isostatic press where it is subjected to an elevated pressure and a high temperature to fuse the material particles and decompose the beads. In making the final porous material, the green body is compacted at a pressure typically below 100,000 psi, more typically 2,000 to 60,000 psi, and especially 10,000 to 50,000 psi; at a For a green body composed of aluminum and polystyrene beads, the pouch is subjected to a pressure of about 30,000 psi and a temperature of about 550° C. for a duration sufficient to fuse the aluminum particles and to decompose the polystyrene beads to gas, which typically takes about one hour.

The product is a porous material wherein the pores are spherical. It appears that regardless of the shape of the beads, the pores in the porous material are spherical.

Having described the invention, the following example is given as a particular embodiment thereof and to demonstrate the practice and advantages thereof. It is understood that the example is given by way of illustration and is not intended to limit the specification or the claims in any manner.

EXAMPLE

This example demonstrates preparation of a porous aluminum cylinder, without a binder, using 225 g of 1100 aluminum powder having average particles size of 65 microns and 25 g of fugitive atactic polystyrene beads having average particle size of 250 microns.

Pursuant to the method described herein, the aluminum powder and the polystyrene beads were placed in a Vee blender, the blender was closed, placed in a stand, and mixed by repeated inversions of the blender until thoroughly blended and random distribution was obtained. The mixing in the blender took about 12 hours.

The mix in the blender or mixer was then transferred to a rubbery bladder cylinder, closed at one end and open at the opposite. The bladder cylinder was 1¼" ID and 6" long. It's thickness was ¼". After the mix was poured into the bladder cylinder, the cylinder was sealed at the top with a stopper of the same rubbery material and a latex tape strap. The bladder was then placed within a standard cold isostatic press, the press was closed and pressurized to 90,000–95,000 psi. The filled bladder cylinder was held and compacted at room temperature at essentially no hold time of 1 to 2 minutes to produce a green body wherein the aluminum powder was compacted to about 90% of its theoretical density. At this point, the beads in the green body were intact and undecomposed.

The cold isostatic press was depressurized and the bladder cylinder was removed from the press. The green body formed in the cold isostatic press, conformed to the shape of the bladder cylinder. The green body was removed from the bladder cylinder and was then wrapped in tantalum foil measuring about 3" wide and about 6" long to prevent diffusion of aluminum from the green body out or from exterior iron in. Tantalum also serves to absorb some of the carbon and gases due to the decomposition of the polystyrene. Since tantalum foil is expensive, the green body was also wrapped, as a precaution, in stainless steel foil measuring about 3" wide and about 6" long. The wrapped green body was then placed into a seam-welded stainless steel pouch, evacuated to about $50\times10^{-3}$ Torr and seam-welded shut. Evacuation was done to remove any trace of oxygen which, if left in the pouch, would react with the metals and carbon present in the pouch and cause other problems.

The filled pouch was then placed into a standard hot isostatic press where it was subjected to a temperature of 550° C. and a pressure of 30,000 psi for one hour. Melting temperature of aluminum is 659° C. and the decomposition temperature of the polystyrene beads is below about 300° C. It is believed that the beads were thermally decomposed to a hydrocarbon gas, such as methane.

After processing in the hot isostatic press, the pouch was removed from the press and the porous aluminum product was removed from the stainless steel and tantalum foils. The product was a cylinder measuring approximately 4.5" in length and approximately 1" in diameter, weighed 125 g, had porosity of about 20%, random pore distribution with mean nearest-neighbor distance of 380 microns, and an average pore size of about 350 microns with the pore sizes varying from about 100 microns to about 500 microns. The pores were generally spherical and closed.

Samples of porous aluminum of different porosities were prepared, as described above, and the graph of FIG. 1 was constructed showing the relationship of weight fraction of the polystyrene beads and porosity of the porous aluminum. As shown in FIG. 1, the relationship of weight fraction of the polystyrene beads to porosity is a straight line function which is indicative of the obvious relationship that porosity increases with increasing amounts of the beads in the porous aluminum samples.

Figure 2:
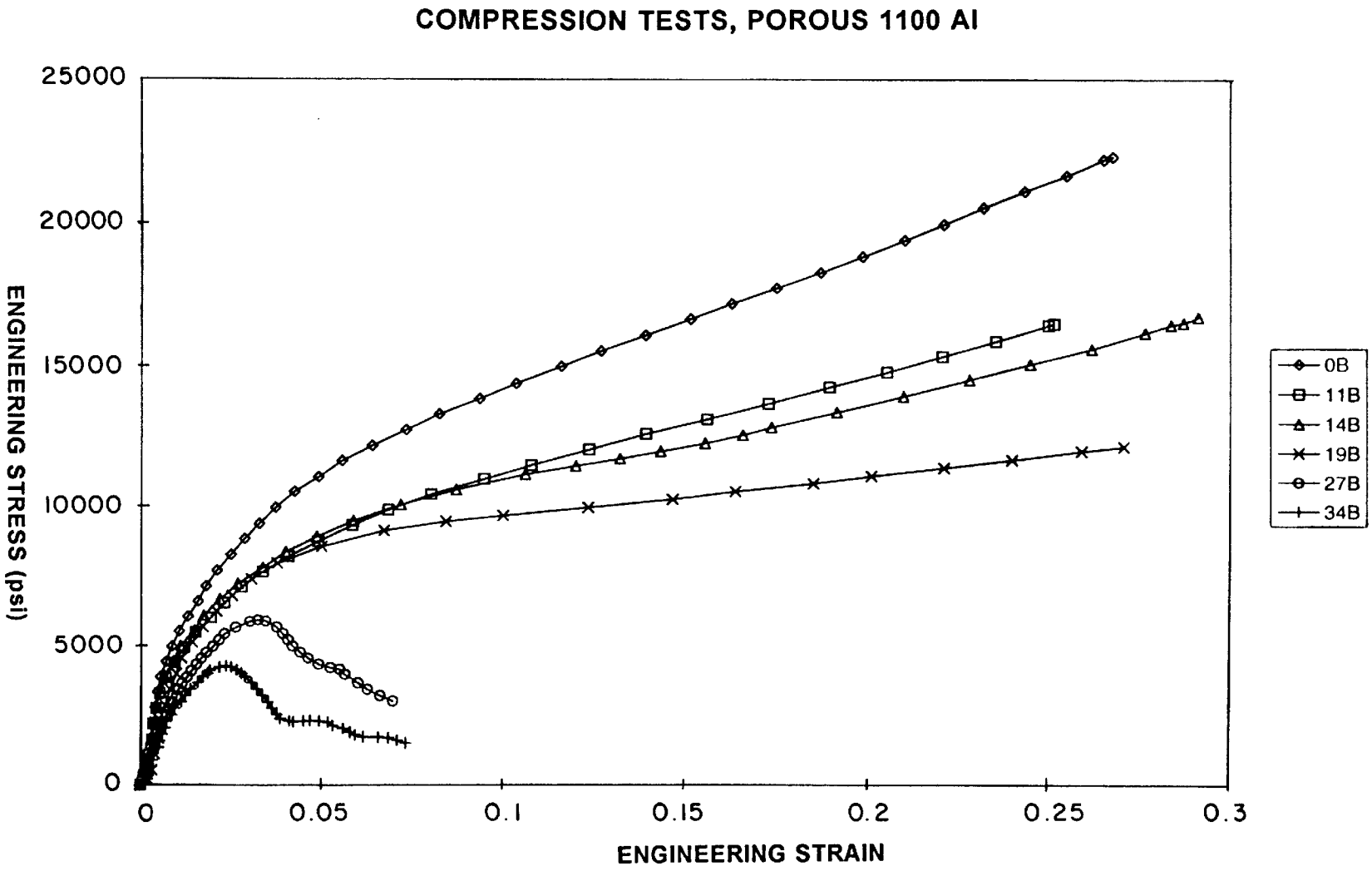
FIG. 2 is a graph which gives relationship of strain and stress of porous aluminum samples varying in porosity from 0 to 34% and indicating a percolation limit between porous aluminum samples having porosity between 19% and 27%.

A number of samples were tested for engineering stress and strain and the graph of FIG. 2 was constructed showing the relationship of the strain to the stress. As FIG. 2 shows, there is a direct correlation between the stress and the strain with increasing amounts of the beads in the porous aluminum samples up to about 19% porosity. Between porosities of 19% and 27%, a percolation limit is reached below which the direct correlation is lost and the stress drops precipitously. A mechanical percolation limit is defined in analogous manner to electrical conductivity in mixtures of conductors and insulators. Typically, this is a value of around 21% and, for the cases shown here, separates ductile and brittle behavior.

The material particle boundaries are not contaminated when the porous material is made as described above. Evidence of this is FIG. 2 wherein samples #11, #14, and #19 show ductile behavior. If the material particle boundaries were contaminated, then samples #11, #14, and #19 would behave more like samples #27 and #34 of FIG. 2. For other metals, processing conditions to minimize metal carbide formation should be selected.

Porosity of a porous material prepared as described herein can be controlled by adding varying amounts of beads. For instance, if weight fraction of the polystyrene beads described above is 0.1, porosity of the resulting porous aluminum is about 22%. Changing the weight fraction of the beads to 0.2, changes porosity of the resulting porous aluminum to about 35%.

The mean nearest-neighbor distance (mnnd) of a random distribution of uniformly sized spherical pores can be estimated from the volume fraction porosity and the pore diameter. The mnnd figure can be obtained from a published graph of porosity versus mnnd by simply taking known porosity of a porous meterial and reading off the mnnd from the graph.

Control of pore size is achieved by selection of an appropriate bead size. Commercially available polystyrene beads sizes from 0.1 microns to 1000 microns.

Control of pore spatial distribution depends on whether one desires a porous product of uniformly or non-uniformly distributed pores. For uniformly distributed pores, the mixing or the blending operation determines the uniformity of the distributed pores. For non-uniformly distributed pores, samples of blends with different weight fractions of the beads are combined to produce the desired porous material. Porous products with porosity gradients or steps can be formed in this manner.

The method described above when compared to prior art methods, particularly the GASAR method, is simpler, does not involve melting, achieves control of pore size and pore distribution more effectively in a different and a more facile way, uses standard and conventional equipment, yields reproducible results, and can be used to make porous materials which cannot be made or are difficult to make using the prior art methods.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method comprising the steps of:

a. mixing a particulate material and beads that are thermally decomposable to a gas to form a mixture;

b. sufficiently compacting the mixture to form a green body that contains undecomposed beads; and c. compacting and heating the green body at a pressure and at a temperature below melting point of the material but above the temperature at which the beads decompose into a gas and the material particles fuse to produce a porous material having pores of a size directly proportional to the size of the beads, certain pore distribution, pore volume fraction and thus the mean nearest-neighbor distance.

2. The method of claim 1 wherein the material is selected from the group consisting of metals, intermetallic compounds, alloys, ceramics and mixtures thereof; and the beads are a plastic.

3. The method of claim 2 wherein the plastic is selected from the group consisting of polystyrene, polyethylene, polyisobutylene and mixtures thereof.

4. The method of claims 2 wherein said compacting step to make the green body is carried out at a pressure of up to 200,000 psi for less than ½ hour and said compacting and heating steps to make the final porous material are carried out by compacting the green body at a pressure below 100,000 psi, at a temperature below melting point of the material, for duration of less than 5 hours.

5. The method of claim 2 wherein said compacting step to make the green body is carried out at a pressure of 10,000–150,000 psi and at a duration of less than ¼ hour; and said compacting and heating steps to make the final porous material are carried out by compacting the green body at a pressure of 2,000–60,000 psi, heating at a temperature at least 50° C. below the melting point of the material but at least 100° C. above the decomposition temperature of the beads, for duration of less than 4 hours.

6. The method of claim 2 wherein said compacting step to make the green body is carried out at a pressure of 60,000–120,000 psi at room temperature and for duration of less than 10 minutes; and said compacting and heating steps to make the final porous material are carried out by compacting the green body at a pressure of 10,000–50,000 psi at a temperature of at least 70° C. below the melting point of the material but at least 200° C. above the decomposition temperature of the beads, for duration of less than 3 hours.

7. The method of claim 5 wherein the plastic is selected from the group consisting of polystyrene, polyethylene, polyisobutylene and mixtures thereof.

8. The method of claim 5 wherein the material is selected from the group consisting of iron, copper, nickel, magnesium, titanium, aluminum, metallic alloys, intermetallic compounds, and mixtures thereof.

9. The method of claim 8 wherein average particle size of the material is up to about 500 microns, and average particle size of the beads is up to about 10,000 microns.

10. The method of claim 8 wherein average particle size of the material is 10–100 microns, and average particle size of the beads is 100–2000 microns.

11. A method comprising the steps of:

a. mixing a particulate metallic material and plastic beads that are thermally decomposable to a gas to form a mixture;

b. sufficiently compacting the mixture to form a green body that contains the undecomposed beads; and c. compacting and heating the green body at a pressure and at a temperature below melting point of the material but above the temperature at which the beads decompose into gas and the material particles fuse to produce a porous material having pores of a size directly proportional to the size of the beads, certain pore distribution, pore volume fraction and thus the mean nearest-neighbor distance.

12. The method of claim 11 wherein the material is selected from the group consisting of metals, intermetallic compounds, metallic alloys, and mixtures thereof.

13. The method of claim 11 wherein the plastic is selected from the group consisting of polystyrene, polyethylene, polyisobutylene and mixtures thereof.

14. The method of claim 12 wherein said compacting step to make the green body is carried out at a pressure of up to 200,000 psi for less than ½ hour and said compacting and heating steps to make the final porous material are carried out by compacting the green body at a pressure below 100,000 psi, heating the green body at a temperature below melting point of the material, for duration of less than 5 hours.

15. The method of claim 12 wherein said compacting step to make the green body is carried out at a pressure of 60,000–120,000 psi at room temperature and for duration of less than 10 minutes; said compacting and heating steps to make the final porous material are carried out by compacting the green body at a pressure of 2,000–60,000 psi at a temperature of at least 70° C. below the melting point of the material but at least 200° C. above the decomposition temperature of the beads for duration of less than 3 hours; and wherein average particle size of the material is 10–100 microns and average particle size of the beads is 100–2000 microns.

16. The method of claim 11 wherein the plastic is selected from the group consisting of polystyrene, polyethylene, polyisobutylene and mixtures thereof; and wherein average particle size of the material is up to about 500 microns and average particle size of the beads is up to about 10,000 microns.

17. The method of claim 16 wherein said mixing step is continued until random distribution of the components of the mixture is attained; wherein said compacting step to make the green body includes the steps of placing the mixture within a flexible container, sealing the container, placing the container into a cold isostatic press, and compacting the mixture to obtain the green body; wherein said compacting and heating steps to make the final porous material includes the steps of wrapping the green body removed from the cold isostatic press and the container in a foil, placing the wrapped green body into a pouch, evacuating the interior of the pouch to a pressure below $50\times10^{-3}$ Torr, sealing the wrapped green body in the pouch so that the pressure within the pouch is below $50\times10^{-3}$ Torr after sealing, placing the sealed pouch into a hot isostatic press, and compacting the green body at a pressure below the pressure used in the cold isotactic press to make the green body and heating the green body to thermally decompose the beads and to fuse the particles of the material and thus form porous material of desired porosity and pore size.

18. The method of claim 17 wherein the material is aluminum having average particle size of about 65 microns; the plastic beads are polystyrene beads having average particle size of about 250 microns; the compacting pressure in the cold isostatic press to form the green body is about 90,000–95,000 psi and is applied to the mixture for about 1–2 minutes; the foil used to wrap the green body is selected from the group consisting of tantalum, stainless steel, and mixtures thereof, the pouch is made from stainless steel; compacting pressure and temperature in the hot isostatic press are about 30,000 psi and about 550° C. and are applied for about 1 hour.

* * * * *